US005189849A

United States Patent [19]

Collins

[11] Patent Number: 5,189,849

[45] Date of Patent: Mar. 2, 1993

[54] ROOF RAIN GUTTER DEBRIS SHIELD/RUN-OFF WATER CONTROL

[76] Inventor: James A. Collins, 109 Wayland Rd., Wilmington, Del. 19807

[21] Appl. No.: 833,143

[22] Filed: Feb. 10, 1992

[51] Int. Cl.[5] ..... E04D 13/00

[52] U.S. Cl. ..... 52/12; 52/11; 52/14

[58] Field of Search ..... 52/11-16

[56] References Cited

U.S. PATENT DOCUMENTS

| | | | |
|---|---|---|---|
| 3,351,206 | 11/1967 | Wennerstrom | 52/12 X |
| 3,950,951 | 4/1976 | Zukauskas | 52/12 |
| 4,271,643 | 6/1981 | Sweers | 52/11 |
| 4,616,450 | 10/1986 | Shouse | 52/12 |
| 4,750,300 | 6/1988 | Winger, Jr. | 52/12 |
| 5,072,551 | 12/1991 | Manoogian, Jr. | 52/12 |

*Primary Examiner*—David A. Scherbel
*Assistant Examiner*—Robert J. Canfield

[57] ABSTRACT

The present invention provides a rain gutter debris shield/run-off water control embodiment for standard residential roof rain gutters, thereby eliminating the myriad debris problems associated thereto, a vertical deflector embodiment means has herein been designed, developed and tested which comprises a diminutive configuration exhibiting extensive adaptability and delivering optimum performance utilizing scientific principles underlying the hydrophilic phenomenon, an integrally constructed embodiment functionally dependent upon a unique vertical deflector exhibiting outstanding water deflection and debris rejection/ejection capabilities, a horizontal capillary cap delivering optimal water leveling and spreading requirements, a roof slope adaptor and its alternate means accommodate every and all roof slope/gutter juxtaposition, thereby eliminating traditional installation problems, a support stabilizer functions to provide stability and rigidity, while preserving the integrity of critical embodiment dimensions, a slope adaptor affixation clip means provides a plurality of attachment means. There is incorporated in this embodiment a unique 20th Century invention requiring no installation tools and it eliminates all damming conditions.

4 Claims, 2 Drawing Sheets

ROOF RAIN GUTTER DEBRIS SHIELD/RUN-OFF WATER CONTROL

RELATED APPLICATIONS

This application is a related applications to: Ser. Nos. 06/859,386 filed May 5, 1986, and Ser. No. 07/042,226 filed Apr. 13, 1987 both of which are now abandoned.

BACKGROUND OF THE INVENTION

This invention is concerned with and relates to water run-off trough systems erected on the eaves of residential buildings, and in particular to improvements to such systems which will eliminate debris, ice, snow, etc. and other objects from lodging in the gutter and obstructing or impeding the normal path of rain run-off water into the gutter and to its final destination.

Most all roof structures are pitched (sloped) and provide gutters at the eaves in order to efficiently control the collection and disposal of rain run-off water to keep it away from the building foundations.

These gutters, however, are a natural receptacle for every conceivable foreign matter carried by gravity, wind and rain run-off. This debris interferes with the proper functioning of the gutters. Many ingenious attempts have surfaced over the years since Benjamin F. Nye, U.S. Pat. No. 603,611, May 3, 1898 conceived of the deflector principle to solve this problem. None to date has been successful in solving the problem intoto.

For example U.S. Pat. Nos. 3,295,264; 4,418,504; 4,965,969 and countless others have employed a sieving or screening means positioned above the trough opening to separate the debris from the water. A screening device becomes a clogging device and they lose their functionality. These devices have been largely rejected as not feasible in the marketplace.

U.S. Pat. Nos. 2,669,950 to Bartholomew and 2,873,700 to Heier were early attempts which did not effectively resolve existing problems. Their shortcomings are obvious, see Prior Art discussion. Other attempts to be noted here are U.S. Pat. Nos. 836,012; 891,405; 891,406; 2,672,832; 4,455,791; 4,435,925; and 4,497,146. Attempts as recently as U.S. Pat. Nos. 4,965,969 Dan E. Antenen, Oct. 30, 1990 and 5,016,404 Jeffrey M. Briggs, May 21, 1991 fail to grasp the need for a unique debris-free system which will accommodate all existing gutter/roof slope juxtapositions, while requiring no tools for installation.

Even though the scientific theory has been available for many years, as far as we know it has never been pragmatically applied, thus never being commercially accepted or put into practice in what one might consider a functionally acceptable embodiment. This may have resulted from the rejection exhibited by consumers to incur extra cost or expense associated with initially high installation cost for an essentially nonperfected product. Market research has verified that to date, no existing gutter shield system, deflector or otherwise, has the pragmatic flexibility and adaptability which make for a trouble-free, fast and efficient installation. Gutter systems personnel and roofers (installers) and consumers etc. will not tolerate time consuming, costly and/or aesthetically unsound installation attempts to "retrofit" existing gutter systems. It appears the major reason why the concept has not found widespread acceptance to date is twofold: 1. the critical design required for efficient function has not surfaced to date; 2. the cost reflected in the fabrication and especially the installation due to insufficient design configurations do not make it practically feasible. The specific shortcomings are myriad and systemically involve areas of design associated with steep slopes, arcuate deficiencies, inadequate support facilities, insufficient hydrophilicity, poor hydroport design, and provide no options regarding roof slope or gutter juxtaposition problems, etc. Whatsoever the insufficiencies, the obvious fact remains the market has not accepted debris shielding/water run-off control devices as a practical solution to this gutter debris problem as of this date. I have developed a means to resolve all existing gutter debris/shield problems. I have invented and disclosed a unique gutter shield embodiment which is applicable and adaptable to any existing eaves gutter system regardless of roof slope angle or gutter juxtaposition. This means requires an essentially level gutter trough and no installation tools. See installation inadequacies of the prior art listed above. These present practical difficulties involving installation conflicts that are generated by cumbersome hardware and insufficient design features that are too rigid and relatively complex structurally, usually requiring gutter relocation difficulties.

Accordingly, the object of the present invention is an eaves gutter means for preventing the passage of most all debris into the subject gutter regardless of how this debris is conveyed. Another object is to provide an eaves gutter with the means to maintain an uninterrupted water run-off system. Another object is to provide a means for preventing entrance of debris into an eaves gutter, wherein said gutter is open for visual inspection and still water evaporation. It is a further object of the present invention to provide means for preventing entrance of debris into an eaves gutter, said means comprising no moving parts, permitting visual inspection, minimal fabrication (cost), no installation tools and being adaptable to all roof slope/gutter juxtapositions. It is a further object to provide means for preventing entrance of debris into an eaves gutter of conventional design whereby any debris detained by said means may be dislodged and purged by natural phenomena, a means whereby damming conditions cannot generate themselves.

Other objects and benefits will become apparent in the course of the following detailed description.

SUMMARY OF THE INVENTION

The objects of the present invention are accomplished in general by designing and providing a debris shield/water control system with integral accessories. A shield of integral design and fabrication embodiment comprising a roof slope adaptor/debris shield portion and its alternate slope adaptor portion which bridges run-off water from roof to gutter, a strengthening flange portion lending strength and installation facilities and advantages, a clip portion for attaching the roof slope adaptor to a capillary cap portion to shield debris and to level and spread water run-off from the roof of a building, a vertical deflector portion positioned below said capillary cap portion and emerging as a sharply defined 90° downward angle extending essentially ¼"–1" in a vertical plane. The surface plane of said vertical deflector portion situated vertically downward to a locus ¾" above the forward uppermost lip portion of the eaves gutter, a downwardly, backwardly positioned re-entry extension portion emerging 60° inwardly from the lower extremity of said vertical deflector portion forming a sharply defined 30° slope angle, a horizontal support flange extending ½" horizontally inwardly from the lower termination extremity of said re-entry portion, a support/stabilizer portion transverses front to back and rests upon a standard eaves gutter therein providing a plurality affixation attachment means at essentially 6-foot intervals along the entire shield embodiment, an optimum ⅜"-½" hydroport opening established between the re-entry extension portion and the upper eaves gutter lip portion providing a critically optimum water entry port with minimum debris tolerance, a rivet attachment means and an optional slotted attachment means for selectively securing the entire embodiment, the entire debris shield/water control embodiment invention being constructed of mill-finish aluminum metal and possessing an inherent affinity for water, is further subjected to a proprietary hydrophilic coating such that the wetting angle of a drop of water, measured by the Sessile Drop Test technique, is preferably close to 5°.

BRIEF DESCRIPTION OF THE DRAWINGS

This invention will be understood from the following description in conjunction with the attached associated drawings wherein:

FIG. 1. specifically incorporates a roof slope adaptor/debris shield in its functioning juxtaposition. FIG. 1 further shows a cutaway view of a rivet fastener means attached to a support flange means to a support stabilizer means. The essential embodiment of this invention is orthographically depicted in conjunction with FIG. 4.

DESCRIPTION OF INVENTION

In order for the embodiment of this invention to function efficiently in accommodating the normal passage of run-off water into the gutter trough while, at the same time preventing leaves, pods and varied kinds of debris from entering therein, a myriad of contributory considerations must be taken into account. Not the least of these considerations are those associated with fabrication, installation, general cost and market acceptability in addition to functional expectations.

It is necessary at this juncture to identify briefly the underlying principles which constitute the scientific working foundation for inventions of this category. It is academic to extensively discuss the chemical, physical and geometric scientific principles which compel a sheet of water to adhere to a hydrophilically sensitive metal surface. This phenomenon is not in need of credibility and is surely not herein being invented again. It is fair to state, however, that in devising a means to shield a standard rain run-off gutter from debris, while congruously providing for normal run-off water control and dissemination, requires knowledge of the aforementioned. Let it suffice to say this subject embodiment necessarily embraces and utilizes all pertinent and available scientific and technical data compiled for general public consumption, to wit: all that varied and scientific knowledge having to do with surface chemistry; general physics; Bernouilli's Fluids in Motion; inertia: coefficient of spreading; molecular attraction; universal gravitation $F=C\ mm^2/S^2$; angular momentum $Iw=GM-CM^2/sec.$; capillary attraction; interfacial tension; molecular cohesion; the Sessile Drop Test Technique (wetting); hydrophilicity; and all the many scientific laws dealing with motion and momentum of flowing fluids.

Figure 1:
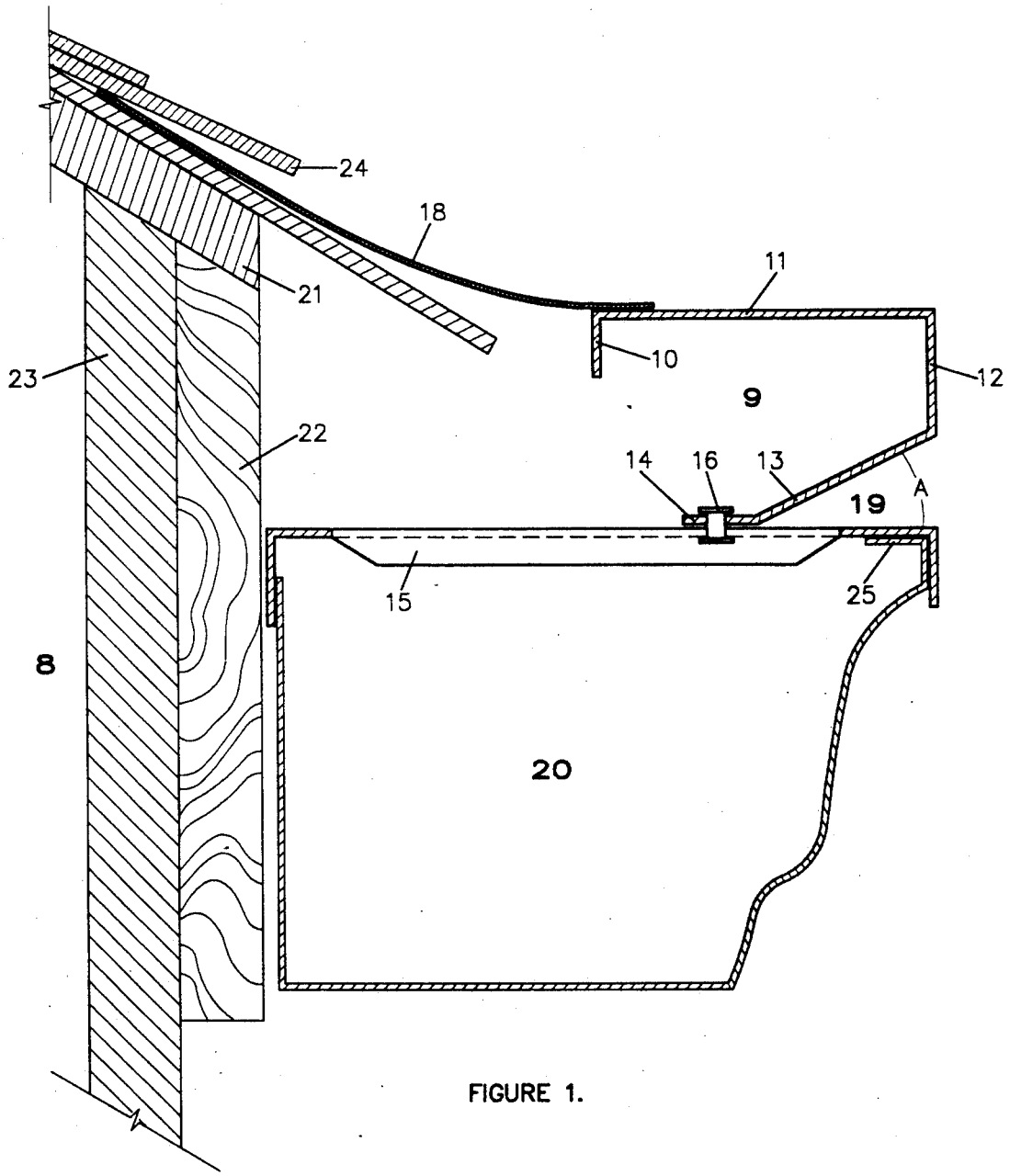
FIG. 1 is a cross-sectional drawing of an embodiment of this invention mounted on the roof eaves of a building in conjunction with a standard eaves gutter attached thereto.

Referring to FIG. 1, a cross section of a gutter shield embodiment 9 is depicted in accordance with the scientific principles; functioning prerequisites and design criteria so dictated. The shield embodiment 9 is illustrated in its functioning juxtaposition on a standard gutter 20. The gutter is attached to an existing building 8 outward of a construction portion 23 and is supported upon a facia 22 at the lower edge of a roof covering 21 below the shingle courses 24. The shingle course 24 has its extreme lower edge protruding out and beyond the lower extremity of roof construction 21 overhanging the gutter 20 thereby providing for water run-off down the roof shingles 24 and into gutter trough 20. As depicted it is an aluminum constructed embodiment positioned above a conventional eaves gutter 20 which is attached to a building facia 22. The shield/water control embodiment 9 is integrally comprised of a vertical strengthening flange segment 10 adjacent to a horizontal cap segment 11 that is adjacent to a flat vertical deflector segment 12, this being adjacent to a lower re-entry extension segment 13 which merges into a horizontal support flange segment 14. A support stabilizer portion 15 provides attachment facilities for rivet fastener means 16 or an optional attachment means 16A. FIG. 1 also shows a roof slope adaptor portion 18integrally associated with but not fabricated as a continuum part of embodiment 9.

Figure 2:
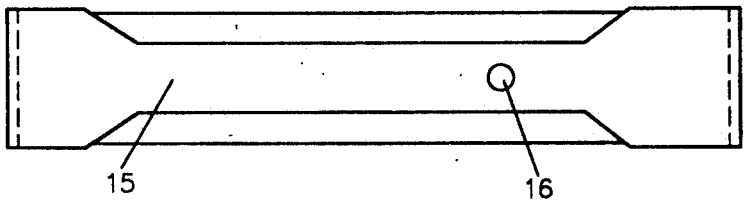
FIG. 2 is a fragmentary top view of a support stabilizer of FIG. 1 depicting the critical rivet hole location for the affixation of the embodiment of this invention.

FIG. 2 depicts a top fragmentary view of support stabilizer portion 15 of FIG. 1, the depicted rivet hole locus establishes the critical juxtaposition for embodiment 9.

Figure 3:
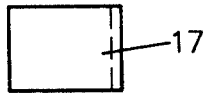
FIG. 3 is a fragmentary top view of the special slope adaptor attachment clip means associated with FIG. 4 of this invention.
Figure 4:
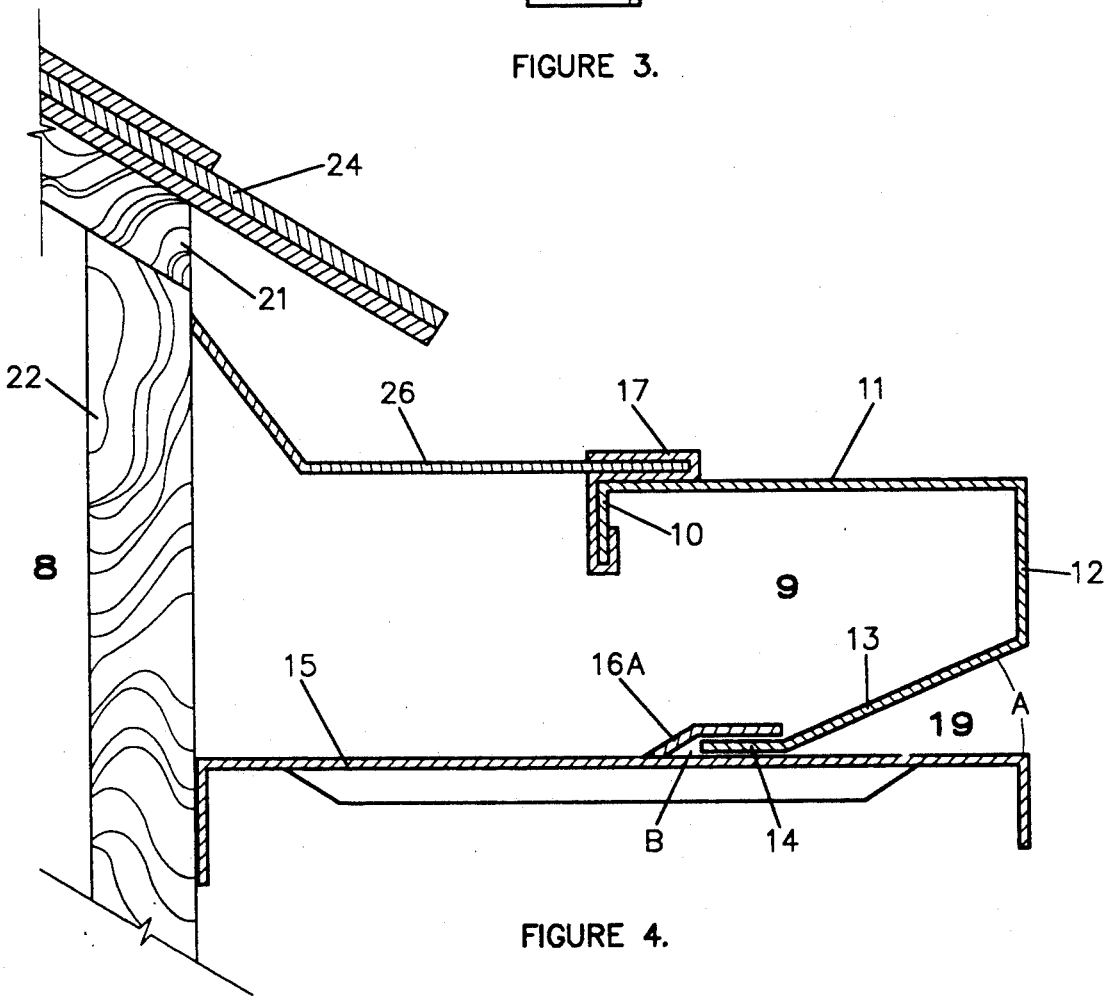
FIG. 4 is a cross-sectional drawing of the embodiment of this invention essentially similar to FIG. 1 showing the alternate roof slope adaptor/debris shield positioned in its operating juxtaposition adjacent to a facia and situated below the shingles of a building and secured in place with a slope adaptor clip attachment means.
Figure 5:
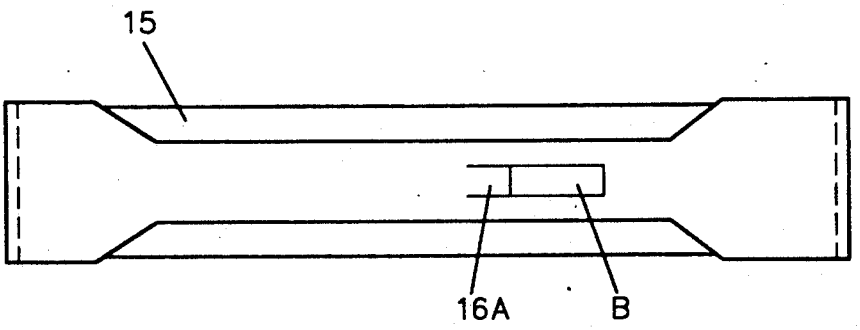
FIG. 5 shows a fragmentary top view of a support stabilizer portion of FIG. 4 in which a critical slotted optional attachment location is clearly depicted.

Referring to FIG. 3, a top fragmentary view shows a slope adaptor clip attachment means 17 of FIG. 4, and FIG. 4 is a cross-sectional view essentially the same as FIG. 1 in structural detail showing an alternate roof slope adaptor/debris shield portion 26 to accommodate roofs with shallow slope angles or those presenting unorthodox gutter juxtaposition problems, and FIG. 5 illustrates a fragmentary top view of support stabilizer portion 15 of FIG. 4 and the attachment/support means for optional slotted fastener portion 16A.

It should be noted at this time that this invention requires only an essentially level gutter trough to ensure a problem-free efficiently-functioning installation. No tools or extraneous hardware is ever required.

From the preceding it will become increasingly apparent, by virtue of the functional and installation attributes of this invention, that a relatively simple and inexpensive means will be available to retrofit eave gutter troughs with a debris shield/water control means of the type herein described.

Consistent with the preceding described embodiment of this invention in association with attached drawings and photos, a roof rain gutter debris shield embodiment 9 is further described as an integral number of components and a number of associated and contiguously functional supportive portions. Referring to FIG. 1 a strengthening flange portion 10 originates as a sharply defined ½"90° vertically downward segment at the backmost inwardmost extremity of capillary cap portion 11, being coextensive in length with embodiment 9 runs the entire length of gutter trough 20, portion 10 while imparting longitudinal strength to the entire embodiment 9, also provides affixation facilities for securing slope fastener clip attachment portion 17 shown in FIG. 3 and FIG. 4. The strengthening flange 10 contributes to a telescoping capability which facilitates an attachment means instrumental in joining, end-to-end, the longitudinal continuum comprising embodiment 9, thus contributing to a one-man installation adjunct. A capillary cap portion 11 evolves as a sharply defined 90° integral angle emerging as a horizontal continuation adjacent the strengthening flange portion 10, being a major horizontal portion of embodiment 9, this horizontal cap portion 11 manifests many scientific principles in its functions as a critical horizontal component serving to level out and spread water run-off cascading from the roof slope adaptor/debris shield portion 18 or its alternate slope adaptor 26, the capillary cap 11 transverses the gutter trough 20 for essentially 3" thus constituting a shield device, it is fabricated of 0.019–0.032 aluminum mill-finish material, a coextensive means, it extends the entire gutter 20 length, the capillary cap 11 horizontal surface juxtaposition is indispensable in controlling this diminutive embodiment's capacity to accommodate the most heavy rain run-off.

FIG. 1 and FIG. 4 illustrate orthographically the integral components which make up embodiment 9, in particular a unique and critically important vertical deflector portion 12, being the forwardmost portion of the gutter shield system, it constitutes a sharply defined 90° angle downwardly adjacent the forwardmost extremity of the capillary cap portion 11, thereafter extending vertically downward optimally ¼"–1" where its lowest vertical extremity locus is essentially ¾" above the uppermost outer extremity of eaves gutter lip portion 25 of gutter 20, its vertical plane being essentially vertically flush with this forward, outermost gutter lip portion 25. The vertical deflector portion 12 virtually eliminates entry of all debris from entering gutter portion 20. The major function of the vertical deflector portion 12 is to receive the run-off of the preleveled efficiently spread modified water from the horizontal capillary cap portion 11 and to redirect (deflect) this flow down and back into gutter trough 20, for disposal. When a vertical deflector 12 is afforded efficient design pathways for run-off and sufficient hydrophilic properties are present, numerous forces of chemistry and physics will cause the run-off sheet of water to show affinity for the metal surfaces. The water will cling (adhere) to the metal, thereby compelling the water to be carried down the vertical deflector 12 and back into the gutter 20. This siphon effect "Coando Effect" is explained by chemical, physical principles. The chemical, physical forces include but are not limited to: relative attraction; universal gravitation forces; hydrophilicity; inertia; angular momentum and interfacial tension to name a few. All these many scientific principles are esoteric within this family of invention and familiar to those associated thereto.

It must be said at this juncture based on pragmatic observations as well as established scientific principles enumerated above, that the standard generic type arcuate deflector will not perform as well as this unique vertical deflector portion 12 of this invention. The vertical configuration performs superbly in both ejecting run-off debris as well as rejecting all manner of debris. Most gutter debris is literally deposited and/or removed by the action of the wind and gravity, any minute debris surviving the vertical deflector 12 portion via the run-off stream is of no consequence and will ultimately wash out of the gutter 20 during heavy rain run-off.

The re-entry extension portion 13 of FIG. 1 and FIG. 4 originates as an integral extension segment adjacent the bottom most extremity of vertical deflector 12 angling downwardly and backwardly as a sharply defined 60° angle from the vertical deflector plane inclining toward facia portion 22 for a distance of 1½" thereafter the re-entry extension portion 13 continues for ½" horizontally backwardly, merging into and becoming a support flange portion 14. Referring to FIG. 1 or FIG. 4 re-entry extension portion 13 inclines downward to conjoin with support stabilizer portion 15 via support flange 14 forming a critical slope angle. The value of said angular slope designated as angle A is optimally 30°–40°, said angle A is developed pragmatically to eliminate all dripping conditions evolving from the bottom of a deflector portion during slow rain run-off. The primary function of re-entry extension 13 is to provide an integral efficient continuous water conveyor system for the essentially debris-free run-off water being diverted by the vertical deflector 12.

A support flange portion 14 emerges horizontally ½" adjacent reentry extension portion 13, imparting linear strength to the entire embodiment 9. It also serves as a support and attachment means for the installation of affixation fastener portions 16, 16A of FIG. 1, 2 and FIG. 4, 5 to rigidly maintain the critical dimensions paramount to the efficient functioning and performance of embodiment 9. The support flange being an integral portion of the embodiment 9 is coextensive with the full length of the gutter portion 20. Embodiment 9 is fastened securely in its designated juxtaposition onto support stabilizer portion 15, fastened by rivet attachment portion 16 during fabrication in FIG. 1, 2 and by die-punch optional slotted affixation fastener means 16A viewed in FIG. 4, 5. Either fastener attachment means makes for a dependable installation.

FIG. 1, 2 and FIG. 4, 5 respectively show orthographic sectional side views and top views of a support stabilizer portion 15 with optional attachment means. FIG. 4 shows a raised integral appendage portion 16A and the ½" slotted attachment means indicated as an opening B along the topmost horizontal surface of support stabilizer 15. Said slot portion B will receive and secure, in its designated location, support flange 14 thus securing the entire embodiment 9 throughout its length being affixed to a plurality of support stabilizers 15 at essentially 6-foot intervals, critical dimensions are thusly maintained and can never be subjected to chance, nor can they be adversely disturbed. Installation tools are never required.

Support stabilizer portion 15 serves to stabilize all critical integral dimensions such as the location of hydroport portion 19 and the vertical deflector portion 12, the entire shield embodiment 9 is dependent in its critical horizontal planes lengthwise and transversely for this degree of stabilization, individual transverse stabilizer supports 15 shown in drawings FIG. 1, 2 and FIG. 4, 5 depicting the individual support stabilizers 15 configuration, consisting of individual horizontal brackets essentially ¾" wide by 5¼" long, utilizing 0.040 aluminum stock, they fit snugly transversing the standard gutter 20 opening from front to back, having sharply defined 90° bends at both transverse extremities front and back, overhanging essentially ½" at either end. The plurality of brackets are at intervals of essentially 4'-to-6' along the entire length of the gutter 20. All transverse and longitudinal sway and/or movement is eliminated, the stabilizer 15 optional fastener attachment facility 16 or 16A provide for fast, secure, easy installations.

FIG. 1 and FIG. 4 show hydroport portion 19 as a critical water passage opening created between the re-entry extension portion 13 and the gutter lip portion 25. The ⅜"–½" opening is coextensive with the entire length of the eaves gutter 20. A hydroport must be maintained sufficiently wide to accommodate optimum roof run-off conditions, yet narrow enough to discourage the entry of most debris carried by natural phenomena. The hydroport portion 19 is a most critical segment of the overall shielding/water control embodiment 9; open, free-flowing, unencumbered run-off must be maintained. Failure to rigidly provide for a water control system that will insure the integrity of this hydroport 19 is unacceptable.

Referring to FIG. 1 a roof slope adaptor/debris shield portion 18 provides the embodiment 9 with 0.019×6"–8" wide aluminum coil sheet metal strip of select lengths, one edge being inserted beneath an appropriate shingle course portion 24, and thereafter coextensive with the entire length of the roof eaves above a standard gutter trough 20, having been secured up and under the shingles 24, the free edge of the slope adaptor/debris shield 18 is now essentially free to establish its own pragmatic slope angle from roof portion 21, coming to rest at any pragmatically acceptable slope, onto the capillary cap portion 11, along the length of gutter portion 20. The flexible, adjustable self-seating extension addition to shingle portion 24 is always free to seek its own slope angle, it provides a debris shield/run-off water control bridge. The unique slope adaptor/debris shield portion 18 will accommodate and adapt to any encountered roof slope presented by the particular architectural demands. The function performed by this portion 18 is to maintain run-off water flow from the lower extremities of roof shingles 24 assuring continuous passage of said water onto a horizontal capillary cap portion 11 for leveling and spreading while shielding the gutter trough 20 from debris. Essentially all damming conditions and associated problems are eliminated utilizing this means.

Alternate roof slope adaptor/debris shield portion 26 functions as an integral and contiguous portion of embodiment 9, the alternate slope adaptor/debris shield 26 is designed to facilitate and accommodate all existing gutter juxtapositions relative to the facia portion 22 which would normally present a troublesome installation interference problem relative to the shingle 24 overhang.

The alternate slope adaptor portion 26 is utilized when slope adaptor portion 18 is not applicable to the special conditions encountered. All the special functions of slope adaptor 18 are duplicated when alternate slope adaptor 26 is employed. Alternate slope portion 26 is essentially 4" wide sheet metal strip of select lengths coextensive with the entire length of the roof facia portion 22 above a standard gutter trough 20, consisting of essentially 0.019"×4" mill-finish aluminum, its outwardmost lateral edge being coextensively conjoined, at selected intervals, with strengthening flange portion 10 by attachment clip means 17. Thereafter having its transverse plane extend backwardly, inwardly in a horizontal mode constituting essentially a backward extension of adjacent horizontal capillary cap portion 11, and causing its backward, inwardmost essentially 1" extension segment to incline upward at a sharply defined essentially 45° angle, to communicate with facia portion 22. The alternate slope adaptor 26 will shield debris and carry run-off water to preferred embodiments 9 for disposal. To provide readily available alternative solutions to various roof slope gutter juxtapositions is a paramount consideration in designing any deflector-type shield embodiment endeavoring to succeed in the marketplace. Essentially all damming conditions and associated problems are eliminated utilizing the above described means.

FIG. 3 and FIG. 4 illustrate a top fragmentary view and a sectional view of an alternate roof slope adaptor clip attachment means 17, a plurality of essentially ½"×½" (90° L)×½" spring interlock attachment means for affixing alternate slope adaptor portion 26 to its conjoined embodiment 9 along its coextensive length with gutter 20.

There may be situations when slope clip attachment means 17 may be required to provide additional means to secure roof slope adaptor/debris shield portion 18 to the embodiment portion 9. However alternate slope adaptor 26 will always require clip portion 17 as a matter of fact. Contrary to general opinion, very few hydrophilic agents are suitable for use as coatings on gutter shielding systems for a number of valid reasons. Many hydrophilic polymers, in spite of possessing polar, oxygen-containing groups such as hydroxyl, carboxyl, etc., which include polyvinyl acetate, polyurethanes and other film-forming polar polymers to name a few, will not perform satisfactorily. Many compounds containing silica or clays, though hydrophilic in themselves, will not lend themselves to adequate inexpensive coatings. The impartation of hydrophilicity to shield material such as aluminum requires chemical reactions involving heat treatment, chemical baths or electric current such as anodizing. Coatings which can be sprayed, dipped or brushed on will not endure weather conditions for any practical period of time. Acids and renegade chemical components present safety hazards which are costly to work with. An acceptable, cost-effective hydrophilic coating must be developed in the laboratory and in the field-testing environment. Testing results to date are proprietary and not for publication at this writing.

The preferred base material of this invention is 0.019–0.032 mill-finish aluminum. The gutter shield embodiment can be fabricated utilizing coiled raw stock, employing brake-forming techniques or extrusion equipment. Mill-finish aluminum has natural hydrophilic properties suitable for gutter shield fabrication. It may be said that this gutter shield is a logical extension of the principles of mechanics as they apply to fluids in motion. This integrally-constructed gutter shield is constructed using a minimum amount of aluminum material for fast, efficient installation at minimal cost. Absolutely no tools are required for installation thus contributing safety margins for installation in questionable locations. Each catenated segment of the embodiment telescopes end-to-end providing progressive support which makes for one-man installations. The entire embodiment is specifically designed with the pragmatic knowledge of the many frustrating roof/gutter installation conditions confronting and challenging this category of invention.

While particular examples of the present invention have been shown and described, it is apparent that changes and modifications may be made therein without departing from the invention in its broadest aspects. The aim of the appended claims, therefore, is to cover all such changes and modifications that fall within the true spirit and scope of the invention.

What is claimed is:

1. A roof rain gutter shield for installation in proximity to both the eaves and the lower shingle extremities of a residential building above and onto a conventional rain gutter trough comprising:

a horizontal capillary cap portion having ½" vertical strengthening flange integrally connected and coextensive along its rearmost extremity, a vertical deflector portion extending in a vertical plane downwardly essentially ¼"–1" from said horizontal capillary cap portion at a 90° angle, a re-entry extension portion extending inwardly toward the building and downwardly toward the gutter trough at a sharply defined essentially 60° angle from a lower extremity of said vertical deflector portion, and a ½" horizontal support flange extending from said re-entry extension portion toward said building, horizontal support stabilizer means provided as attachment means for attaching said roof rain gutter shield to said conventional rain gutter trough, and a roof slope adaptor provided between the lower shingle extremities and said horizontal capillary cap portion so that said roof rain gutter shield can accommodate various gutter and eave displacements.

2. A roof rain gutter shield in accordance with claim 1, wherein said horizontal capillary cap portion transverses said gutter trough for essentially 3" so as to shield debris and control water run-off.

3. A roof rain gutter shield in accordance with claim 1, whereby said horizontal support stabilizer means comprises a plurality of transverse support stabilizer means.

4. A roof rain gutter in accordance with claim 1, wherein said roof slope adaptor is independent of said roof rain gutter shield.

* * * * *